US005447215A

United States Patent [19]

Volkmar et al.

[11] Patent Number: 5,447,215

[45] Date of Patent: Sep. 5, 1995

[54] PORTABLE DESK WITH STORAGE AREA

[76] Inventors: Wendy R. Volkmar, P.O. Box 9354, South Lake Tahoe, Calif. 96158; Barbara J. Roberts, 1019 St. Charles Place, Thousand Oaks, Calif. 91360

[21] Appl. No.: 93,189

[22] Filed: Jul. 16, 1993

[51] Int. Cl.[6] ..... A45C 9/00; A45C 11/36

[52] U.S. Cl. ..... 190/11; 190/109; 190/110; 206/214

[58] Field of Search ..... 190/11, 900, 901, 902, 190/40, 108, 109, 110, 125; 206/214; 108/25, 43

[56] References Cited

U.S. PATENT DOCUMENTS

| | | | |
|---|---|---|---|
| 384,124 | 8/1826 | Hood | 206/214 X |
| 797,514 | 8/1905 | Hinsdill | 206/214 |
| 1,849,771 | 3/1932 | Smith et al. | 206/214 |
| 2,822,847 | 2/1958 | Cesaroni, Jr. | 190/11 X |
| 3,110,375 | 11/1963 | Uggerby | 190/11 |
| 3,232,397 | 2/1966 | McCoy | 190/11 X |
| 3,295,643 | 1/1967 | Peterson et al. | 190/125 X |
| 4,227,283 | 10/1980 | Mathewson et al. | 220/338 X |
| 4,244,632 | 1/1981 | Molinari | 190/109 X |
| 4,406,379 | 9/1983 | Anderson et al. | 220/338 X |
| 4,422,640 | 12/1983 | Tamarkin | 108/25 X |
| 4,463,848 | 8/1984 | Parker | 206/214 |
| 4,483,427 | 11/1984 | Gerch | 190/11 |
| 4,538,861 | 9/1985 | Hughes, Jr. | 190/11 X |
| 4,609,084 | 9/1986 | Thomas | 190/110 |
| 4,842,133 | 6/1989 | LaBarge et al. | 190/109 X |
| 4,874,119 | 10/1989 | Winter | 190/110 X |
| 5,004,091 | 4/1991 | Natho et al. | 190/40 X |
| 5,018,609 | 5/1991 | Brenner | 190/109 X |
| 5,028,048 | 7/1991 | Watson et al. | 190/110 X |
| 5,065,847 | 11/1991 | Hsieh | 190/900 X |
| 5,081,936 | 6/1992 | Drieling | 108/25 X |
| 5,115,893 | 5/1992 | Terkildsen | 190/11 |
| 5,242,056 | 9/1993 | Zia et al. | 190/110 X |

FOREIGN PATENT DOCUMENTS

| | | | |
|---|---|---|---|
| 2403442 | 7/1975 | Germany | 206/214 |
| 6452403 | 2/1989 | Japan | 190/110 |
| 8554 | of 1892 | United Kingdom | 206/214 |
| 2232639 | 12/1990 | United Kingdom | 206/114 |
| 9115133 | 10/1991 | WIPO | 190/11 |
| 9206838 | 4/1992 | WIPO | 190/125 |

*Primary Examiner*—Sue A. Weaver
*Attorney, Agent, or Firm*—Jeffrey P. Aiello

[57] ABSTRACT

A portable desk with a substantial storage area and a stable work surface is provide. A rigid box member has a front wall with a height less than a height of a back wall. A pair of side walls extend between the front wall and the back wall. At least one of the side walls has an elongated elastic strip affixed to its inner periphery at spatially positioned intervals. At least one of the side walls has a flexible enclosure demountably affixed to its outer periphery. A bottom portion of the box member has a plurality of strips of spatially positioned hook and loop fabric fasteners affixed to an inner surface thereof. The bottom portion has a slip resistant outer surface thereof to prevent the desk from slipping off of a user's lap. A rigid lid member is rotatably coupled to the back wall of the box member. The lid member has a groove extending across the width of an outer surface thereof. The groove is dimensioned to hold a writing instrument. An inner surface of the lid has a multiplicity of flexible compartments affixed thereto. An adjustable strap is detachably coupled to each of the side walls of the box member for ease of carrying the portable desk.

3 Claims, 3 Drawing Sheets

PORTABLE DESK WITH STORAGE AREA

BACKGROUND

1. Field of the Invention

The subject invention relates generally to carrying cases for children and the like, and more particularly, to a portable desk that has a stable working surface and an enclosed storage area.

2. Description of Prior Art

There is a wide variety of portable flexible form satchels used today that enable children and young adults to carry personal articles with them. These satchels include tote bags, knapsacks, backpacks and duffel bags. Often these satchels have pockets and divided storage areas to separate articles. The satchels are usually carried using a shoulder strap, a handle, or on a back of a user with a pair of shoulder straps.

Alternatively, there are rigid portable boxes for storing personal items and trays for use as a working surface during transit. One such box is sold under the trade name "The Busy Box" and distributed through a "Miles Kimball ©, Summer Edition" mail order catalogue from Oshkosh, Wis. The box is described as a "take-along" box comprising a plastic bin that has a chalkboard on top. The chalkboard slides off the top for access to an inside of the box.

A portable tray sold under the trade name "The Bean Board Lap Desk" is also distributed through the "Miles Kimball ©, Summer Edition" mail order catalogue from Oshkosh, Wis. The portable tray comprises a smooth pressed hardboard top that includes a paper/-pencil holder and a carrying handle. A fabric bag is filled with plastic beanbag filling and is affixed to the hardboard. A pouch may be placed beneath the hardboard to hold papers.

Another portable tray is sold under the trade name "It's a Puzzle Desk! It's a Lap Tray!" and distributed through a "Joan Cook ©, Summer Edition" mail order catalogue out of Peabody, Mass. The Lap Tray includes a polypropylene top surface that has raised edges. A storage compartment is coupled to the top. A soft pillow is coupled to a bottom of the storage compartment.

Still another portable tray is sold under the trade name "Great New Lap Tray" and distributed through the "Joan Cook ©, Summer Edition" mail order catalogue out of Peabody, Mass. The Lap Tray comprises a textured plastic tray that has edges on all four sides. A lightweight pillow of poly beads is affixed to a bottom surface of the tray.

A disadvantage of the various satchels is that they are substantially flexible and do not provide a stable working surface. A disadvantage of the cited portable trays and boxes is that they provide a substantially limited storage area. A further disadvantage of portable trays is that there are no means provided to prevent items from moving freely in the storage area, which could cause damage to those items. A further disadvantage of the cited portable trays is that they typically extend parallel to a users lap when placed thereon. Since the laps of children usually extend downwardly, items on the tray tend to roll across and fall off the tray. Yet another disadvantage of the referenced portable trays is that they may slide on a users lap. A still further disadvantage of existing portable trays is that there is not a secure place to store items outside of the storage area.

OBJECTS OF THE INVENTION

There exists a need for a portable desk that provides a substantial storage area, where items are inhibited from freely moving about, while providing a stable work surface.

It is therefore an object of the present invention to provide an improved portable desk with a storage area;

It is another object of the present invention to provide a portable desk with a stable working surface;

It is a further object of the present invention to provide a portable desk with a substantial storage area;

It is still another object of the present invention to provide a portable desk with a storage area having means to prevent items from moving freely therein;

It is yet a further object of the present invention to provide a portable desk that has a slippage resistant covering;

It is yet a further object of the present invention to provide a portable desk that inhibits items from falling off a lid member thereof; and It is another object of the present invention to provide a portable desk having means for demountably securing objects to an outer surface thereof.

SUMMARY OF THE INVENTION

These and other objects and advantages of the present invention are achieved by providing a portable desk with a substantial storage area and a stable work surface.

A rigid box member has a back wall and a front wall. The front wall has a height less than a height of the back wall. A pair of tapered side walls extend between the front wall and the back wall. At least one of the side walls includes securing means affixed to its inner periphery. At least one of the tapered side walls includes demountable couple means affixed to its outer periphery.

A bottom portion of the box member has detachable retaining means affixed to an inner surface. The bottom portion has a rough outer surface to prevent the desk from slipping off of a user's lap.

A rigid lid member has a back end rotatably coupled to the back wall of the box member. The lid member is dimensioned to cover the box member. The lid member has an outer surface with a holding means extending across its width. An inner surface of the lid has a multiplicity of flexible compartments affixed thereto. A flange member is integrally formed at a front end of the lid member. The flange member is formed with the lid member, such that it is flexible relative thereto. The flap member includes means for detachably coupling the lid member to the box member.

An adjustable strap is detachably coupled to each of the side walls of the box member for ease of carrying the portable desk.

BRIEF DESCRIPTION OF THE DRAWINGS

The present invention, both as to its organization and manner of operation, together with further objects and advantages, may be understood by reference to the accompanying drawings.

DETAILED DESCRIPTION OF THE PREFERRED EMBODIMENTS

Figure 3:
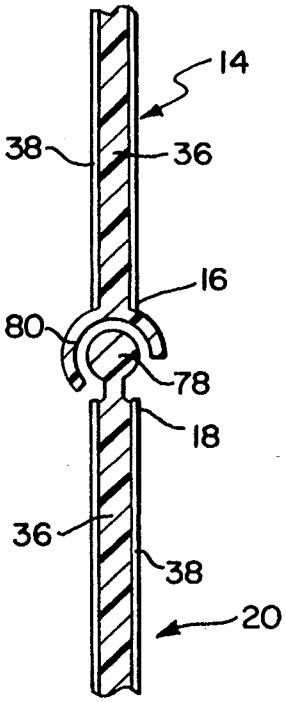
FIG. 3 is a cross sectional view of a hinge of the present invention.
Figure 2:
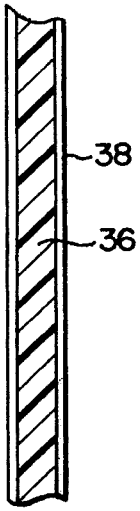
FIG. 2 is a fragmentary cross sectional view of the present invention.

The following descriptions are provided to enable any person skilled in the art to make and use the invention and sets forth the best modes contemplated by the inventors for carrying out there invention. Various modifications, however, will remain readily apparent to those skilled in these arts, since the generic principles of the present invention have been defined herein.

Referring to FIGS. 1, 2, 3, and 4, a portable desk 10, constructed according to the preferred embodiment of the present invention is shown. The portable desk 10 includes a box member shown generally at 12 and a lid member shown generally at 14. The lid member 14 is dimensioned to cover the box member 12. The lid member 14 provides a stable work surface. The lid member 14 has a back edge 16 rotatably coupled to a top edge 18 of a back wall 20 of the box member 12 (best seen in FIG. 3). The box member 12 provides a substantial storage area. The box member 12 further includes a front wall 22, a first side wall 24, a second side wall 26, and a bottom portion 28. The front wall 22 has a height $H_1$ less that a height $H_2$ of the back wall 20. Each side wall 24, 26 has a top edge 30 that tapers from the back wall 20 to the front wall 22. A flap portion 32 is flexibly coupled to a front end 34 of the lid member 14.

In the preferred embodiment, the front wall 22 is substantially 12" long with a height $H_1$ of 3". The back wall 20 is 12" long and has a height $H_2$ of 4". The side walls 24, 26 are 12" long and taper in height from 4" to 3". The bottom portion 28 is 12" long by 12" wide. The lid member 14 is substantially 12" long by 12" wide with the flap portion 32 is $2\frac{1}{4}$" wide.

The box member 12 and the lid member 14 are comprised of a suitable rigid, substantially light plastic material. In the preferred embodiment, the box member 12 and lid member 14 comprise polyvinyl chloride (PVC) 36, enclosed by a layer of fabric 38 (best seen in FIG. 2). The fabric may comprise 70D nylon as sold under the trade name "Cordura" and manufactured by DuPont. The lid member 14 may further have a laminate of PVC 36 disposed on an outer surface 42 (best seen in FIG. 4) thereof. Alternatively the box member 12 and lid 14 may comprise PVC 36, enclosed by a substantially thin layer of vinyl fabric (not shown).

The preferred embodiment of the invented portable desk 10 is fabricated by first forming or cutting portions of PVC 36 to correspond to the front wall 26, back wall 20, and side walls 24, 26 of the box member 12. A single portion of PVC is formed for the lid 14 and flange 32. A concavity 40 is formed across the width of the portion of PVC 36 to form the flange 32. The concavity 40 flexibly couples the flange 32 to the lid member 14. The layer of fabric 38 is then wrapped tightly around the PVC 36 then held in place by sewing, if the fabric 38 is nylon for example. The fabric 38 may be heated to shrink fit the fabric. The PVC 36, if the fabric 38 is vinyl, for example. The various portions of PVC 36 are then affixed to each other, by sewing for example, to form the box member 12. The lid member 14 may have a laminate of PVC on its outer surface 42.

An outer surface 44 of at least one of the side walls 24, 26 has a demountable couple means 46 affixed thereto. In the preferred embodiment, the demountable couple means 46 comprises an elongated portion of either hook or loop retaining fabric that is affixed to the outer surface 44 of the desired side wall 24, 26, by sewing, for example. The portion of retaining fabric 46 is substantially 9.5 inches long and 1.5 inches wide.

An elongated elastic strip 50 is affixed to an inner surface 48 of at least one of the side walls 24, 26. The elastic strip is 9 inches in length and 0.75 inch wide. The elastic strip 50, is affixed to the inner surface 48 of the desired side wall 24, 26 at 0.5 inch intervals. The elastic strip 50 extends parallel to the bottom portion 28. The elastic strip 50 is affixed to the inner surface 48 of the desired side wall 24, 26 substantially 1.5 inches above the bottom portion 28.

Detachable couple means 54 are affixed to an outer surface 52 of the front wall 22 and an inner surface 56 of the flap portion 32. In the preferred embodiment, the detachable couple means 54 comprises a pair of rectangular portions of hook or loop retaining fabric 54 that is affixed to the outer surface 52 of the front wall 22, with corresponding portions of hook or loop retaining fabric 54 affixed to the inner surface 56 of the flap portion 32. The portions of retaining fabric 54 are inset substantially 2.5 inches from outer edges 58 of the front wall 22 and outer edges 60 of the flap portion 32. The portions of retaining fabric 54 are substantially 2 inches long and 1 inch wide.

An elongated flexible enclosure 62 and a collapsible pocket 64 are demountably attached to the demountable couple means 46. The flexible enclosure 62 is comprised of 70D nylon fabric, for example, and has a flap 66 to prevent objects from falling out of the enclosure 62. The flexible enclosure 62 has sides 68 that expand outwardly to accommodate items (not shown) that may be placed therein. The flexible enclosure 62 is substantially 2.75 inches wide and 7.5 inches long. The collapsible pocket 64 has collapsible sides 70 that expand outwardly to allow the pocket 64 to receive desired objects (not shown). In the preferred embodiment the pocket 64 is dimensioned to receive desired writing instruments, such as "Crayons" as manufactured by Sargent Art Inc. of Hazleton, Pa., and pens and pencils. In the preferred embodiment, the pocket 64 is substantially 3.75 inches high and 2.5 inches wide, with a depth of 1 inch.

A plurality of retaining means 72 are affixed to the bottom portion 28. The retaining means 72 are spatially positioned, such that a first pair of retaining means 72 are located proximal to the first side wall 24, and a second pair are located proximal to the second side wall 26. The retaining means 72 comprise an elongated portion of hook retaining fabric 73 and an elongated portion of loop retaining fabric 74. The portions of hook 73 and loop 74 fabric are sewn to the bottom portion 28 and are 6 inches long and 1 inch wide.

A pair of elongated elastic retaining members 76 are affixed to the bottom portion 28. The retaining members 76 extend from the back wall 20 to the front wall 22 and extend parallel to the side walls 24, 26. The retaining members 76 comprise elastic strips that are substantially 12 inches long and 1 inch wide. The elastic strips 76 are inset 3.5 inches from the side walls 24, 26.

Figure 1:
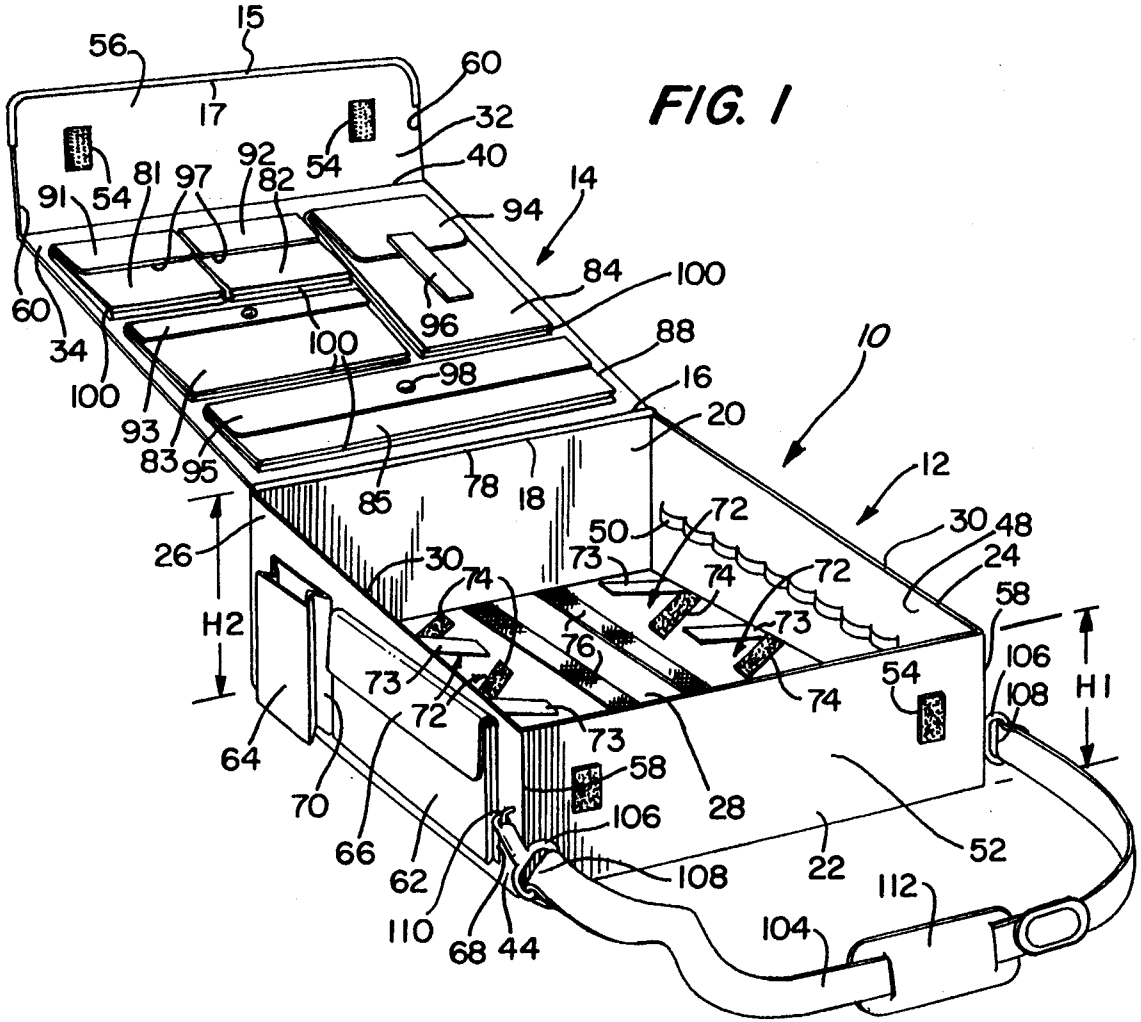
FIG. 1 is a perspective view of a preferred embodiment of the present invention.
Figure 4:
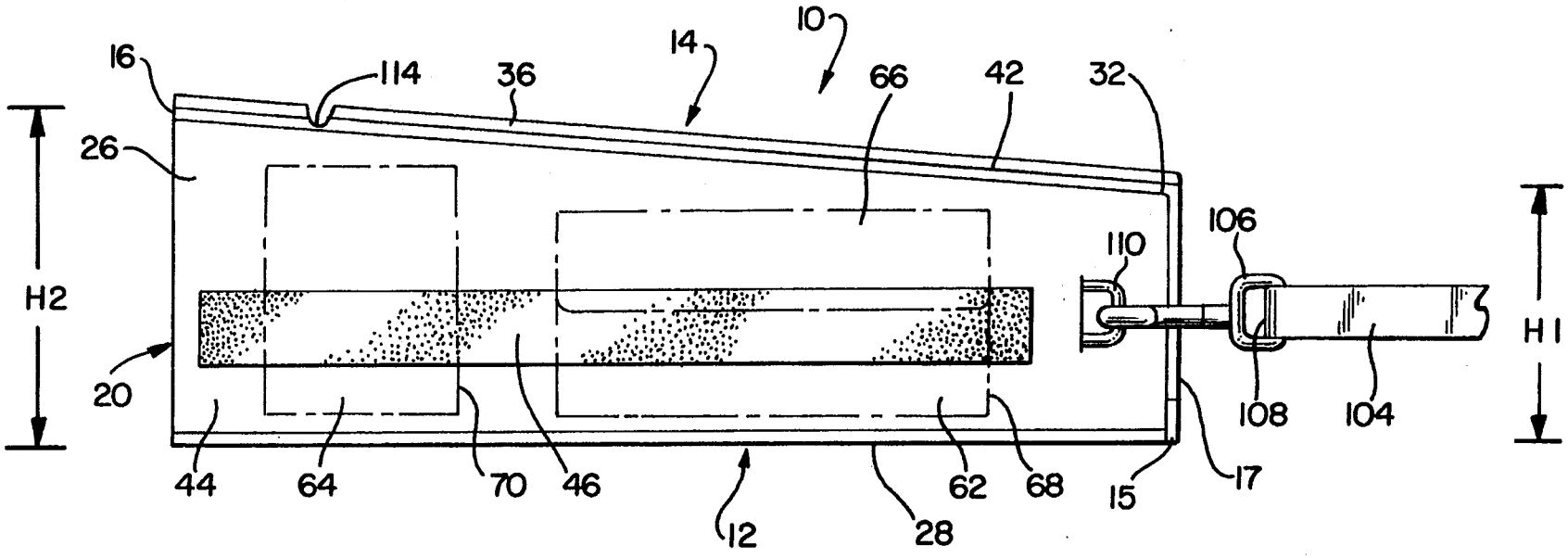
FIG. 4 is a side view of the preferred embodiment of the present invention.

Referring now to FIGS. 1 and 3, the lid member 14 is rotatably coupled to the back wall's top edge 18 with a tube member 78 that extends its length. The lid member's back edge 16 has an elongated channel 80 with a configuration complementary to the tube member 78. The channel 80 is press-fit over the tube 78 for rotatably coupling the lid 14 to the box member 12. Alternatively the back wall's top edge 18 may be rotatably coupled to the lid member 14 by sewing the layer of fabric 38 that covers the lid 14 to the layer of fabric 38 that covers the back wall 20.

An elongated plastic cover 15 is affixed to a front edge 17 of the lid's flap portion 32. The plastic cover 15 prevents the nylon fabric 38 from fraying.

A number of flexible pockets 81, 82, 83, 84, 85 are affixed to an inner side 88 of the lid member 14. The flexible pockets 81, 82, 83, 84, 85 may comprise any desired configuration, such that the multiplicity of pockets 81, 82, 83, 84, 85 substantially covers the lid's inner side 88. In the preferred embodiment, the pockets 81, 82, 83, 84, 85 are comprised of a transparent plastic material to enable viewing of items (not shown) stored in the pockets 81, 82, 83, 84, 85. The pockets 81, 82, 83, 84, 85 have flaps 91, 92, 93, 94, 95 to prevent items from falling out of the pockets while the desk 10 is being carried. Closing means 96, 97, 98 are used to secure the flaps 91, 92, 93, 94, 95 to the pockets 81, 82, 83, 84, 85. The closing means 96, 97, 98 may comprise a snap fastener 98, portions of hook and loop retaining fabric 96, or a zip closure 97. The pockets 81, 82, 83, 84, 85 include expandable sides 100 so that the pockets 81, 82, 83, 84, 85 can expand to accommodate items placed therein.

An adjustable strap member 104 is detachably coupled to the outer sides 44, of the side walls 24, 26 at a location proximal to the front wall 22. Rotatable hard plastic clips 106 are affixed to ends 108 of the strap 104. The plastic clips 106 detachably couple to hard plastic loops 110. The loops 110 are affixed to the side walls 24, 26 at a location proximal to the front wall 22. The strap 104 may comprise any suitable woven fabric and may include a rubber or plastic pad 112 slidably coupled thereto.

Figure 5:
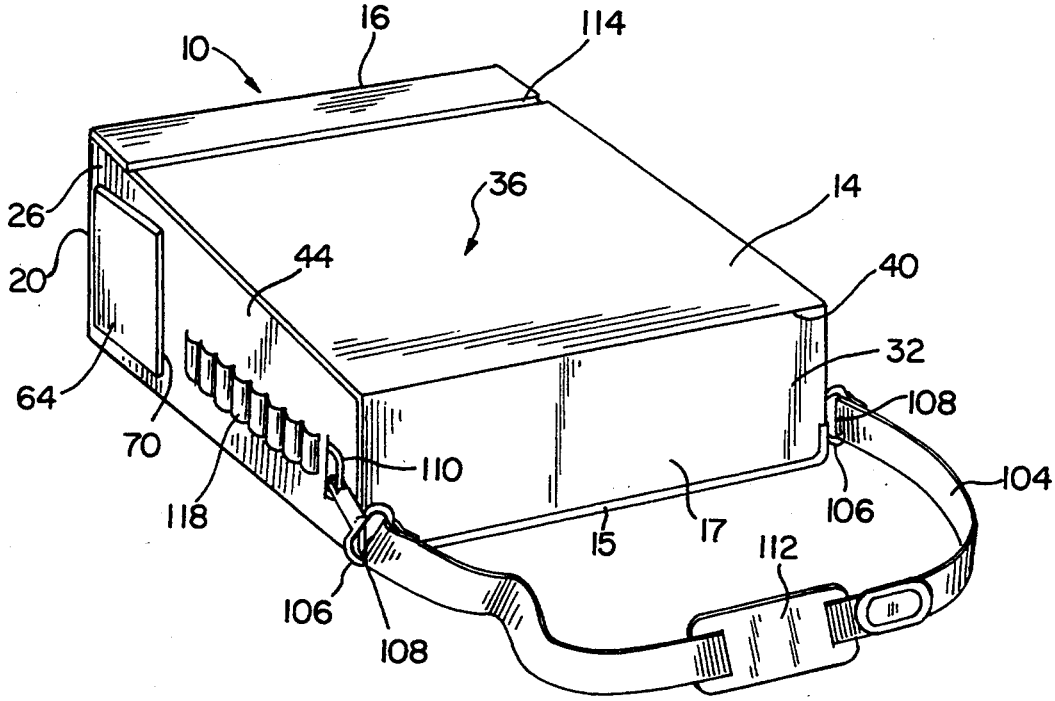
FIG. 5 is a top perspective view of the preferred embodiment.
Figure 6:
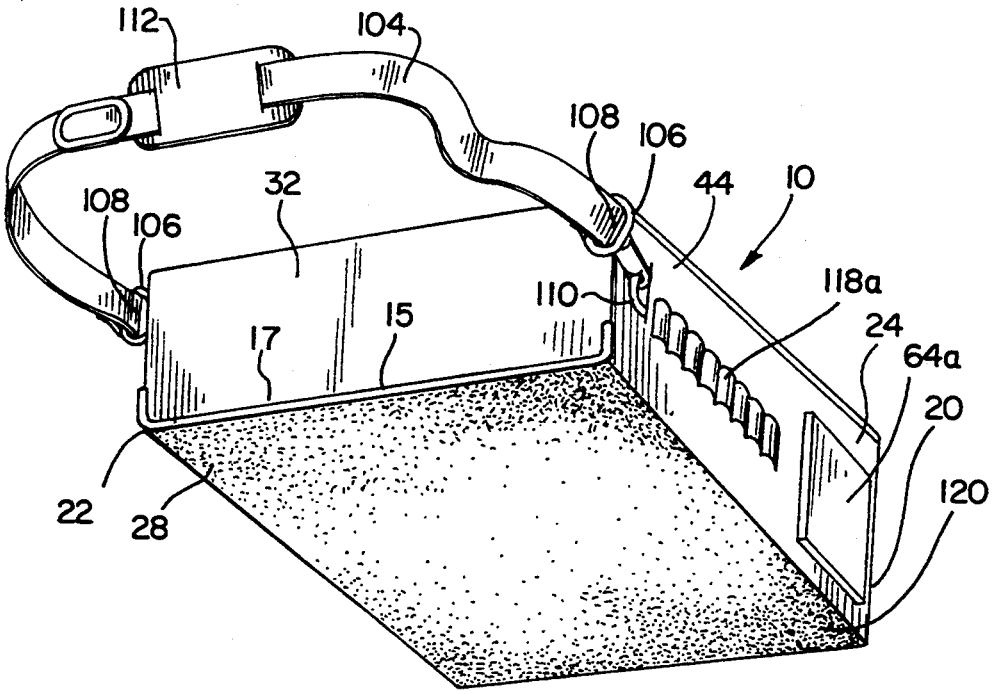
FIG. 6 is a bottom perspective view of an alternative embodiment of the present invention.

Referring now to FIGS. 5 and 6, a laminate of PVC 36 may be disposed on the lid member's outer surface 42. An elongated holding means 114 (also shown in FIG. 4) is located proximal to the lid's back edge 16 and extends parallel thereto. The holding means 114 is inset approximately 0.5 inch from the lid's back edge 16 and may comprise a groove 114. The groove 114 is dimensioned to hold writing instruments, such as Crayons, pencils and the like. The groove 114 is $\frac{3}{8}$ inch deep and $\frac{3}{8}$ inch wide.

In an alternative embodiment, a wide portion of resilient fabric 118 is shown affixed to the outer surface 44 of the second side wall 26, and a second wide portion of resilient fabric **118*a* is affixed to the outer surface 44 of the first side wall 24. The wide portions of resilient fabric 118, 118*a* are affixed to the side wall's outer surface 44 by sewing for example. The resilient fabric 118, 118*a* may comprise elastic that is 0.75 inch wide and 7.5 inches long. The resilient fabric 118, 118*a* is sewn to the side wall 26 at 0.5 inch intervals to retain writing instruments, such as Crayons, therein. Collapsible pockets 64, 64*a* are shown permanently affixed to the side wall 24, 26 by sewing. The collapsible pockets 64, 64*a* includes collapsible sides 70 to adapted the pocket 64** to objects that may be placed therein.

Referring now particularly to FIG. 6, there is shown an outer surface 120 of the box member's bottom portion 28 of the invented portable desk 10. The outer surface 120 comprises a slip resistant surface to prevent the desk 10 from slipping off of a user's lap. In the preferred embodiment, the outer surface 120 comprises neoprene or other suitable slip resistant rubber, for example.

While the above features of the preferred embodiment of the present invention teach the general features of the invention, it can readily be appreciated that it would be possible to deviate from the above embodiments of the present invention and, as will be readily understood by those skilled in the art, the invention is capable of many modifications and improvements within the scope and spirit thereof. Accordingly, it should be understood that the invention is not to be limited by the specific embodiment, but only by the spirit and scope of the appended claims.

What is claimed is:

1. A portable desk comprising:

a rectangular box member comprising;

a back wall and a front wall, said front wall having a height less than a height of said back wall, each of said walls having a top edge, a bottom edge, an outer surface, and an inner surface, said walls having a rough fabric disposed over the outer and inner surfaces thereof, said front wall having detachable couple means affixed to the outer surface thereof, said back wall including a tube member integrally formed at the top edge thereof and extending the length of said top edge;

a pair of side walls, a first side wall having a front end affixed to a first end of said front wall and having a back end affixed to a first end of said back wall, a second side wall having a front end affixed to a second end of said front wall and having a back end affixed to a second end of said back wall, said side walls having an inner surface and an outer surface with a rough fabric disposed about a periphery thereof, said side walls having a bottom edge and a top edge that tapers from said back wall to said front wall, one of said side walls including demountable couple means affixed to the outer surface thereof, one of said side walls having a substantially wide elongated portion of resilient fabric affixed to the outer surface thereof, said wide portion of resilient fabric extending parallel to the length of said side wall, at least one of said side walls having a pair of elongated resilient strips affixed to the inner surface thereof, said strips extending parallel to the length of said side walls and affixed thereto at spatially positioned intervals, at least one of said side walls including an elongated flexible enclosure and a flexible pocket member demountably affixed to said demountable couple means;

a bottom portion having a slip resistant outer surface for inhibiting relative slippage between said desk and a surface, said bottom portion further including an inner surface and an outer periphery, said bottom portion affixed at its outer periphery to the bottom edge of each of said walls, said bottom portion having a plurality of strips of spatially positioned hook and loop fabric fasteners affixed to the inner surface thereof and located adjacent the outer periphery thereof, a first pair of said fabric fasteners located proximal to the bottom edge of said first side wall and a second pair of said fabric fasteners located proximal to the bottom edge of said second side wall, said bottom portion further including a pair of elongated elastic strips extending from the bottom edge of said front wall to the bottom edge of said back wall, said strips affixed to the inner surface of said bottom portion adjacent to the periphery thereof and extending parallel to said side walls;

a rigid lid member dimensioned to cover said box member and adapted to provide a stable work surface, said lid member including an elongated channel integrally formed at a back edge thereof, said channel having a configuration complementary to the tube member formed at the top edge of said back wall and rotatably coupled thereto for rotatably coupling said lid member to said back wall, said lid member having an outer surface and an inner surface, said lid member comprising;

a groove in the outer surface of said lid member and extending across the width thereof, said groove located proximal to the back edge of said lid member and adapted to hold writing instruments therein;

a multiplicity of flexible compartments affixed to the inner surface thereof;

a flange member integrally formed at a front end of said lid member, said lid member having a concavity formed across the width thereof for flexibly coupling said flange member to said lid member, said flange member including means for detachably coupling said lid member to said box member affixed to an inner surface thereof; and carry means comprising an elongated strap member having ends with clips affixed thereto, said clips adapted to detachably couple to loops affixed to the outer surface of each of said side walls at a location proximal to said front wall for carrying said portable desk.

2. The portable desk of claim 1 wherein said demountable couple means comprises a portion of one of hook and loop material affixed to the exterior surface of at least one of said side walls of said box member.

3. The portable desk of claim 1 wherein the slip resistant outer surface of said bottom portion comprises rubber.

* * * * *